US010960533B2

(12) United States Patent
Zeng

(10) Patent No.: US 10,960,533 B2
(45) Date of Patent: Mar. 30, 2021

(54) TOOL BOX

(71) Applicant: Guo-Rong Zeng, Taichung (TW)

(72) Inventor: Guo-Rong Zeng, Taichung (TW)

( * ) Notice: Subject to any disclaimer, the term of this patent is extended or adjusted under 35 U.S.C. 154(b) by 240 days.

(21) Appl. No.: 16/278,199

(22) Filed: Feb. 18, 2019

(65) Prior Publication Data

US 2020/0262049 A1 Aug. 20, 2020

(51) Int. Cl.
*B25H 3/02* (2006.01)

(52) U.S. Cl.
CPC ..... *B25H 3/02* (2013.01)

(58) Field of Classification Search
CPC ..... B25H 3/02; B25H 3/021; B25H 3/023; B25H 3/025; B25H 3/00; E05D 7/1005; E05D 1/044; E05D 2007/126; E05D 5/12; E05D 2005/102; E05D 15/50; E05D 15/502; E05D 15/505; E05D 15/507; E05D 7/10; E05D 7/105; E05D 7/1055; E05D 7/1044
USPC ..... 206/373, 372; 16/229, 230, 231
See application file for complete search history.

(56) References Cited

U.S. PATENT DOCUMENTS 5,769,260 A * 6/1998 Killinger ..... A45C 13/005 220/4.23
6,375,007 B1 * 4/2002 Huang ..... B25H 3/023 206/373
2006/0011624 A1 * 1/2006 Shih ..... B25H 3/02 220/4.24
2008/0035510 A1 * 2/2008 Brunson ..... B25H 3/021 206/373
2016/0145905 A1 * 5/2016 Lu ..... E05B 65/5276 292/336.3

* cited by examiner

*Primary Examiner* — Steven A. Reynolds

(57) ABSTRACT

A tool box includes a first part and a second part, and the first and second parts are pivotably connected to each other by a pivotal portion located at the first side of each of the first and second parts. A locking assembly is connected to the second side of each of the first and second parts. The pivotal portion includes two blocks on the first part and each block has a pivot extending therefrom. The second part has two rails and two slides are slidably along the two rails. Each slide has a groove in which the rail is slidably received. Each slide has a passage, and each of the pivots is removably inserted into the passage corresponding thereto to easily assemble or dis-assemble the first and second parts.

7 Claims, 13 Drawing Sheets

TOOL BOX

BACKGROUND OF THE INVENTION

1. Fields of the Invention

The present invention relates to a tool box, and more particularly, to a tool box composed of two parts which are able to be rapidly assembled.

2. Descriptions of Related Art

The conventional tool box is generally composed of two parts which are pivotably connected to each other so as to form a room between the two parts to accommodate tools therein. The two parts are pivotably connected to one side thereof, and a locking assembly are located on the other side of the two parts. One of the two parts has two pivots and the other one of the two parts has two blocks. The two pivots are pivotably connected to the two blocks to pivotably connect the two parts. The locking assembly ensures that the tool box is secured to prevent tools in the tool box from dropping out from the tool box.

However, it is experienced that the pivots and the blocks are easily worn out due to impact and frequent operation. Once the pivots and/or the blocks are broken, the tool box cannot be closed or opened properly.

The present invention is intended to provide a tool box that is designed to eliminate the drawbacks mentioned above.

SUMMARY OF THE INVENTION

The present invention relates to a tool box and comprises a first part and a second part. The first and second parts are pivotably connected to each other by a pivotal portion located at the first side of each of the first and second parts. The first part has two blocks formed on the first side thereof, and a recessed area is formed between the two blocks. Each block has a pivot extending from one end thereof, and the two pivots extend in the recessed area. The second part has two rails formed on the first side thereof. Two slides are slidably connected the first side of the second part. Each slide has a groove in which the rail is slidably received. The two rails and the two slides are located corresponding to the recessed area of the first part. Each slide has a passage, and each of the pivots is removably inserted into the passage corresponding thereto. Each rail includes a base portion, a first recessed portion and a second recessed portion, wherein the first recessed portion is formed between the base portion and the second recessed portion. Each slide is movable along the base portion, the first recessed portion and the second recessed portion of the rail corresponding thereto. Each rail has an end portion formed on the distal end of the second recessed portion to prevent the rail from separating from the groove. The resistance between the base portion and an inside of the groove is larger than that between the first recessed portion and the inside of the groove. A locking assembly is connected to the second side of each of the first and second parts.

Preferably, the second part includes a stop formed thereto which is located within the recessed area of the first part. The stop is formed between the two rails. Two ends of the stop respectively stop the two slides.

Preferably, the two passages are parallel to the two grooves.

Preferably, the two pivots shares a common axis.

Preferably, the base portion of each rail extends from the stop.

Preferably, the stop includes a support face which is substantially perpendicular to the two ends of the stop.

Preferably, the locking assembly includes two locking units formed on the second part, and two locking seats formed on the first part. The two locking units are engaged with the two locking seats to lock the first and second parts together.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
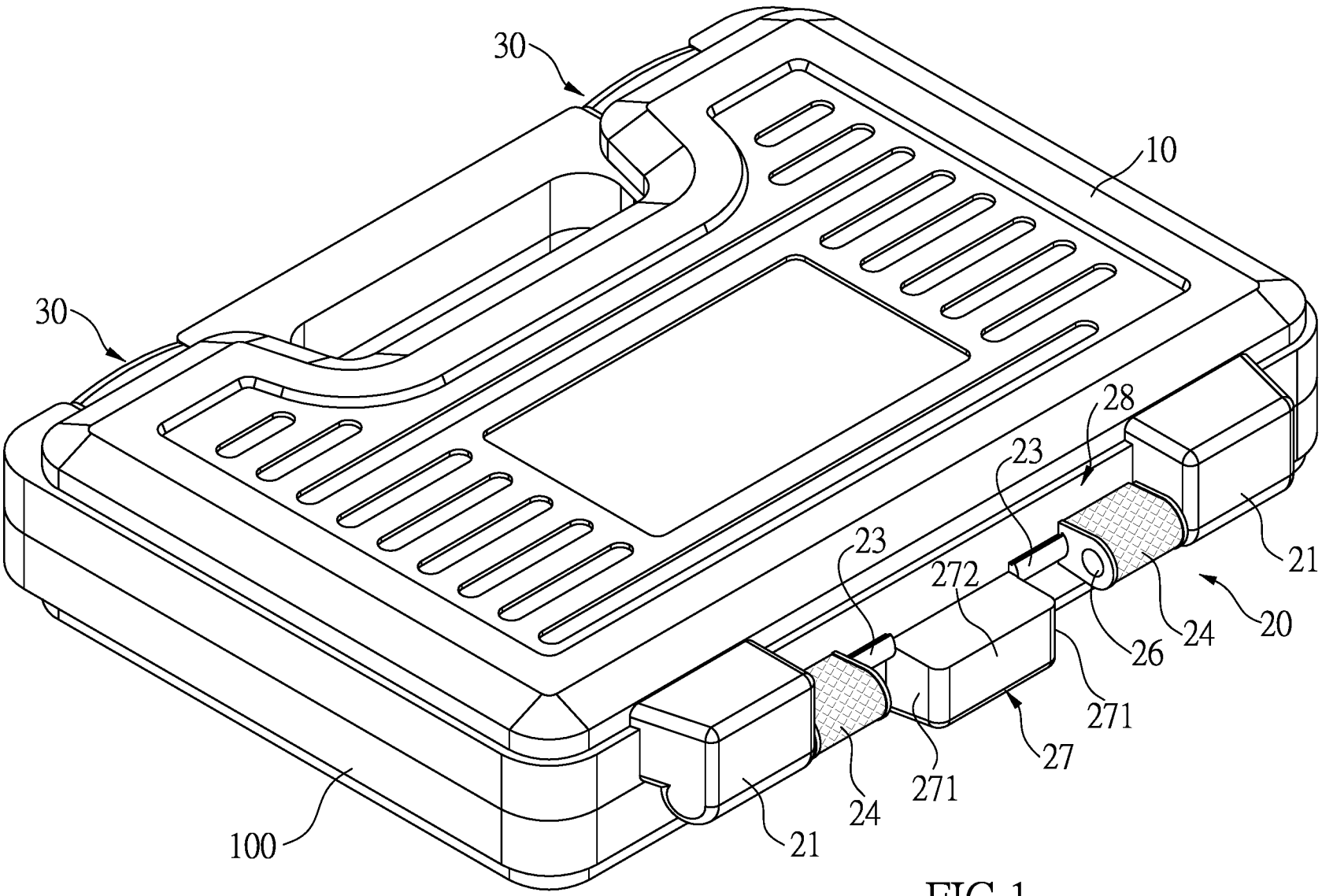
FIG. 1 is a perspective view to show the tool box of the present invention.

Referring to FIGS. 1 to 8, the tool box of the present invention comprises a first part 10 and a second part 100, the first and second parts 10, 100 are pivotably connected to each other by a pivotal portion 20 located at the first side of each of the first and second parts 10, 100. A locking assembly 30 is connected to the second side of each of the first and second parts 10, 100 so as to lock the tool box. A room is defined between the first and second parts 10, 100 when the first and second parts 10, 100 are locked to each other so as to accommodate tools and parts therein.

Figure 2:
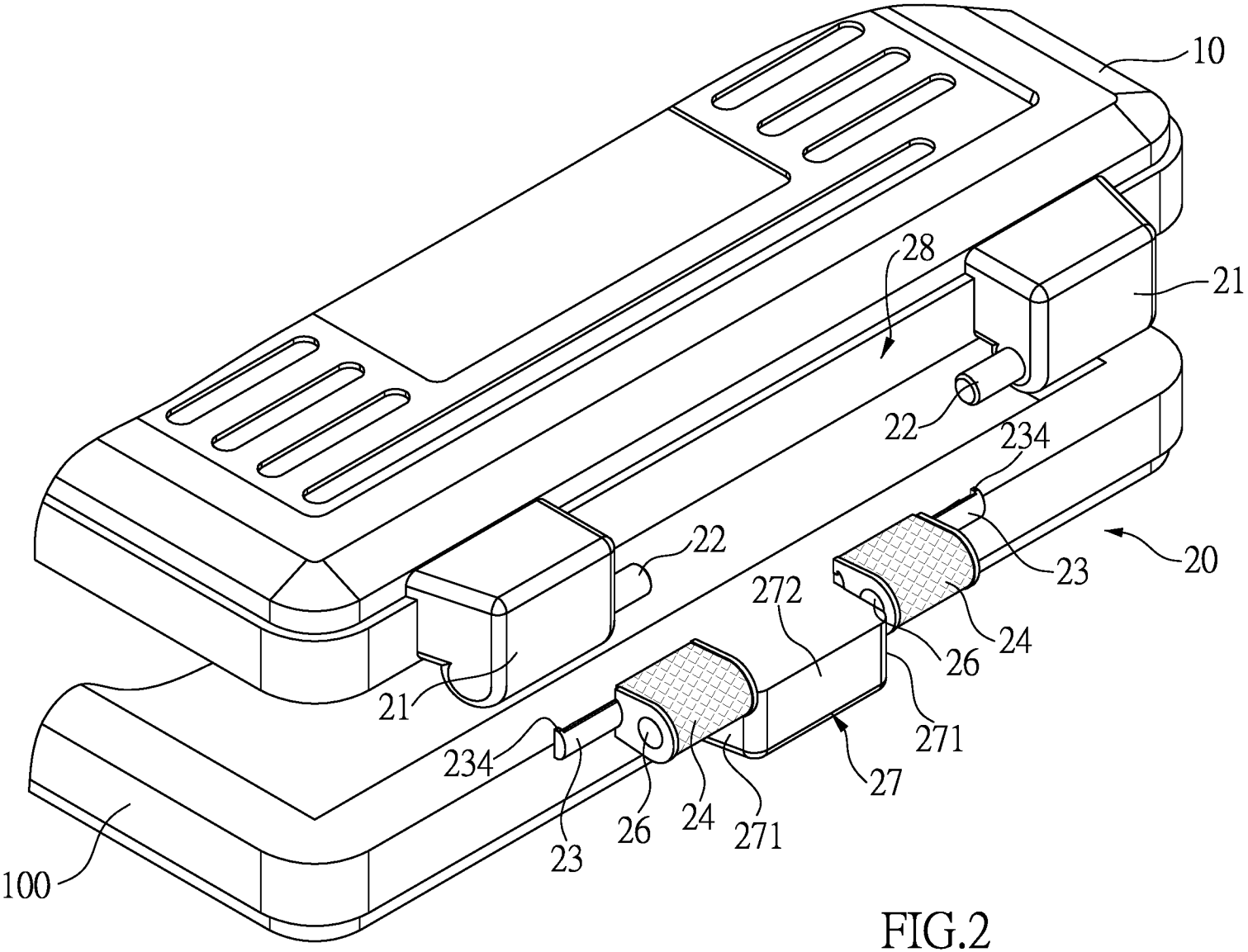
FIG. 2 shows the pivotal portion of the tool box of the present invention.

As shown in FIG. 2, the first part 10 has two blocks 21 formed on the first side thereof, and a recessed area 28 is formed between the two blocks 21. Each block 21 has a pivot 22 extending from one end thereof, and the two pivots 22 extend in the recessed area 28. The two pivots 22 shares a common axis.

Figure 3:
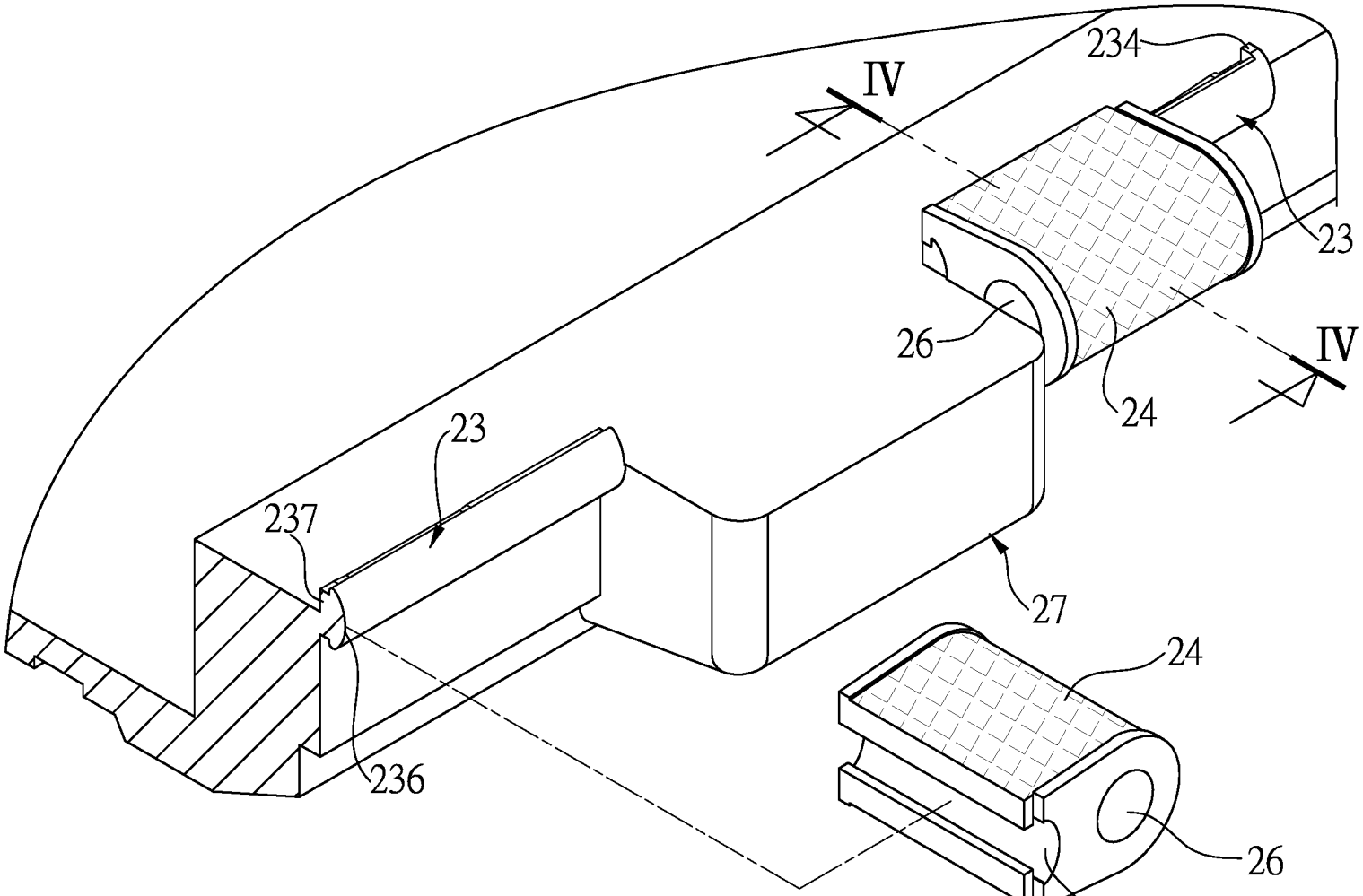
FIG. 3 shows the slide to be engaged with the rail of pivotal portion of the tool box of the present invention.
Figure 4:
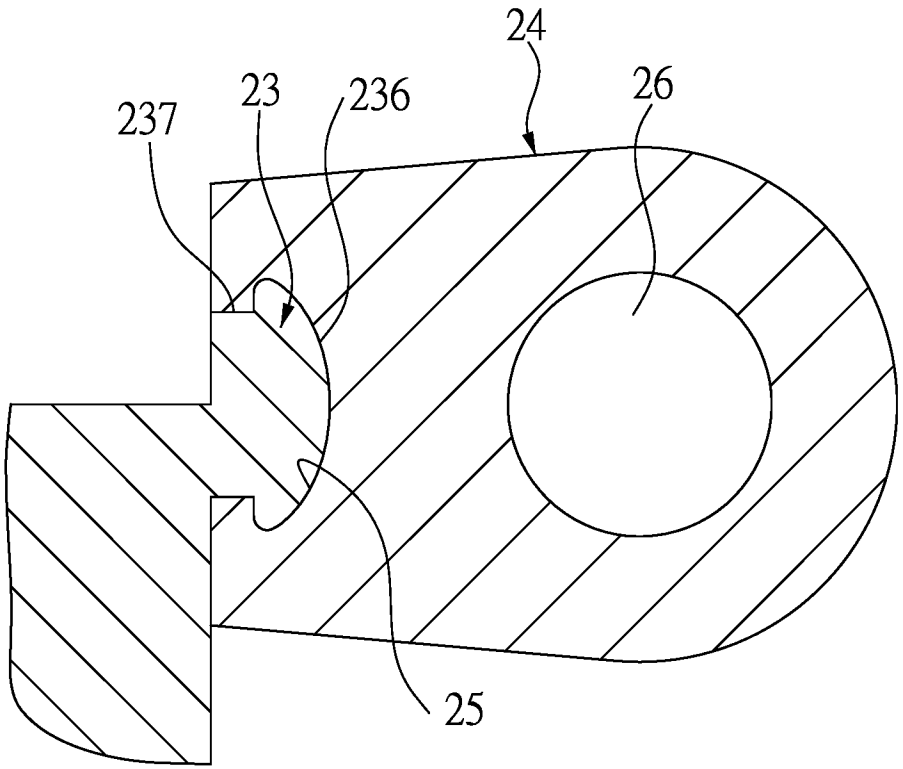
FIG. 4 is a cross sectional view, taken along line IV-IV of FIG. 3.
Figure 5:
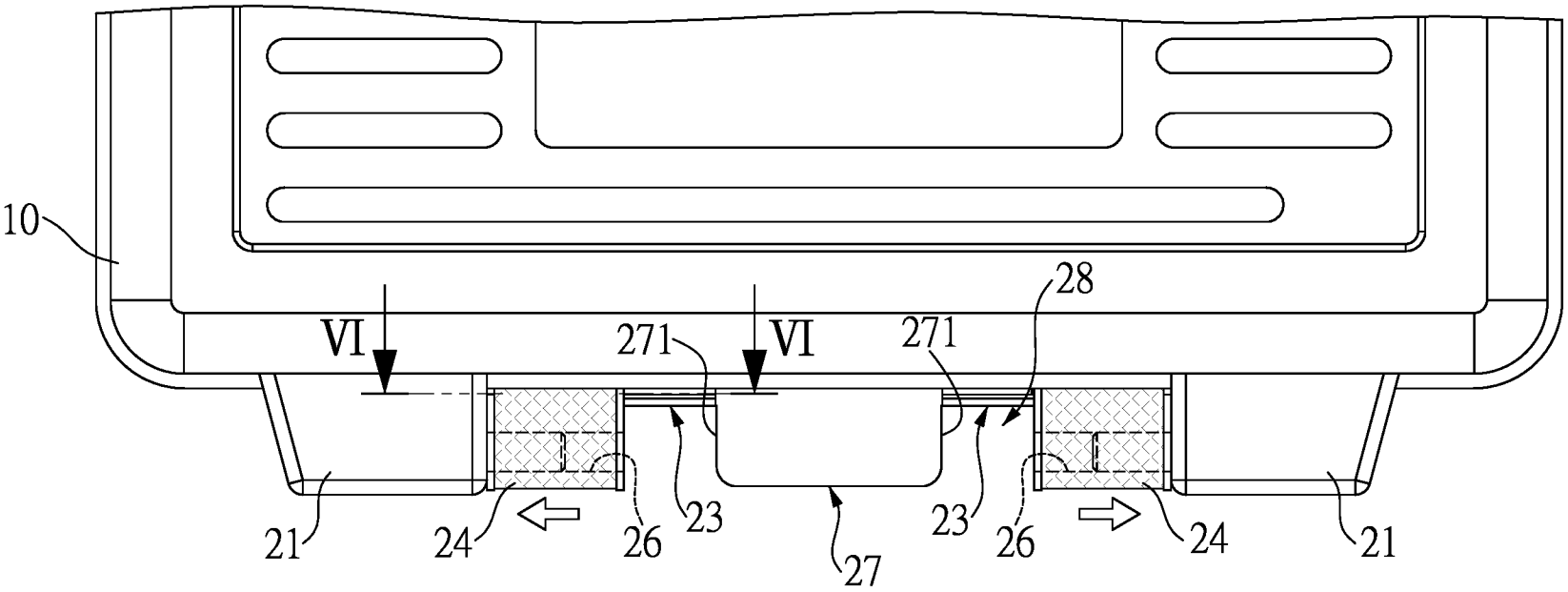
FIG. 5 shows that the pivots are inserted into the slides.
Figure 6:
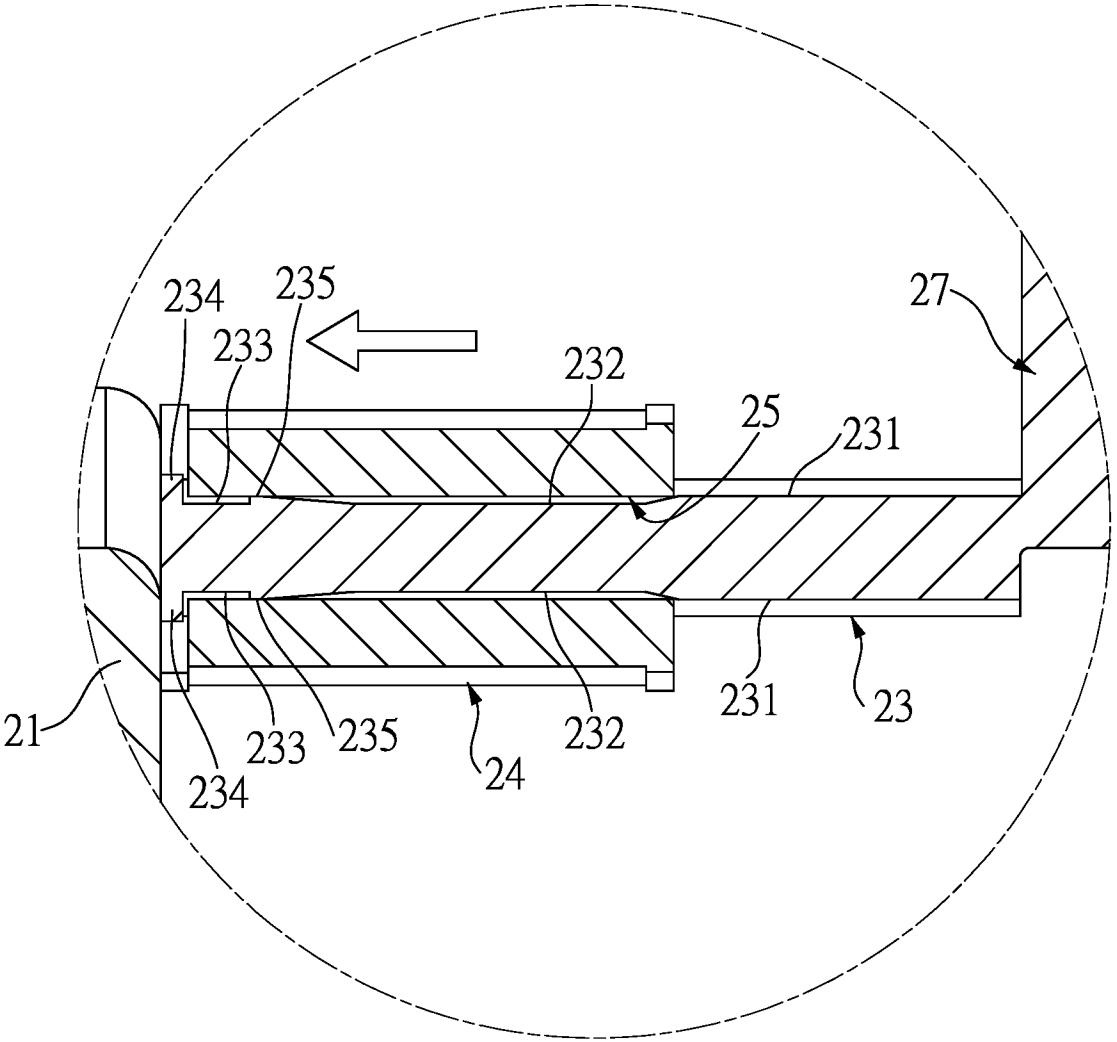
FIG. 6 is a cross sectional view, taken along line VI-VI of FIG. 5.
Figure 7:
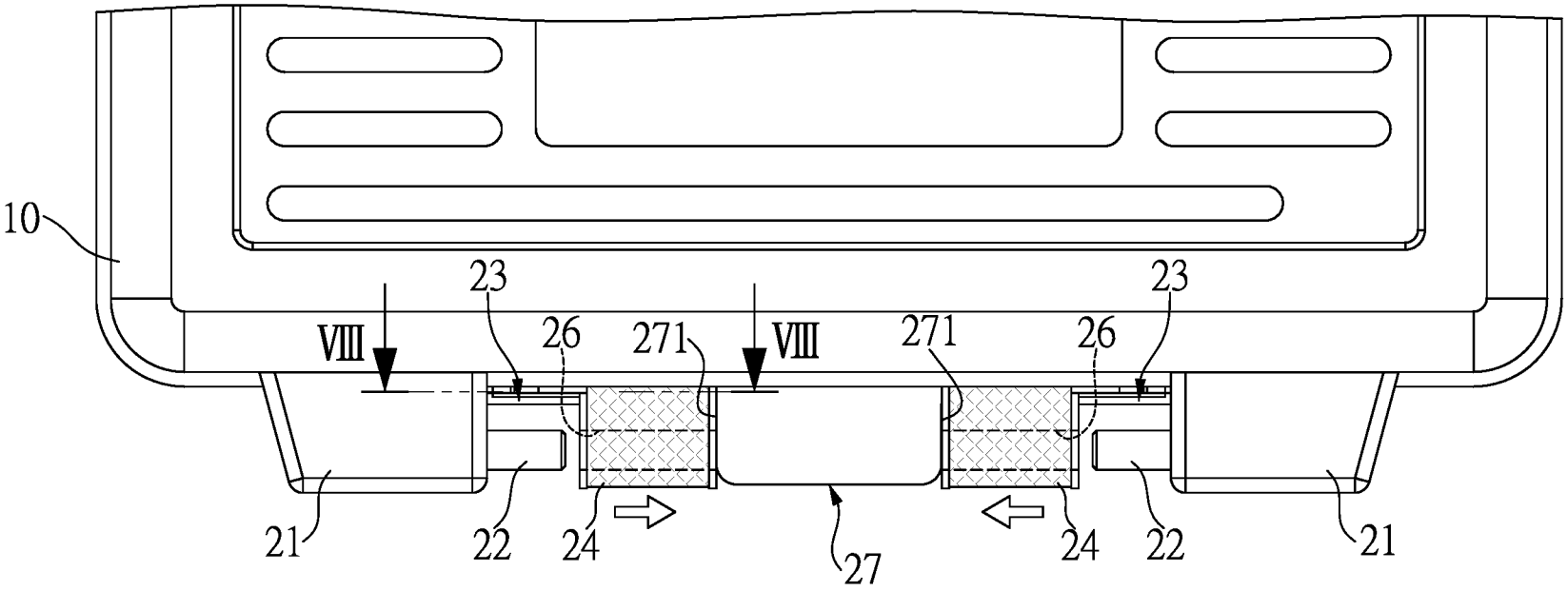
FIG. 7 shows that the pivots are separated from the slides.
Figure 8:
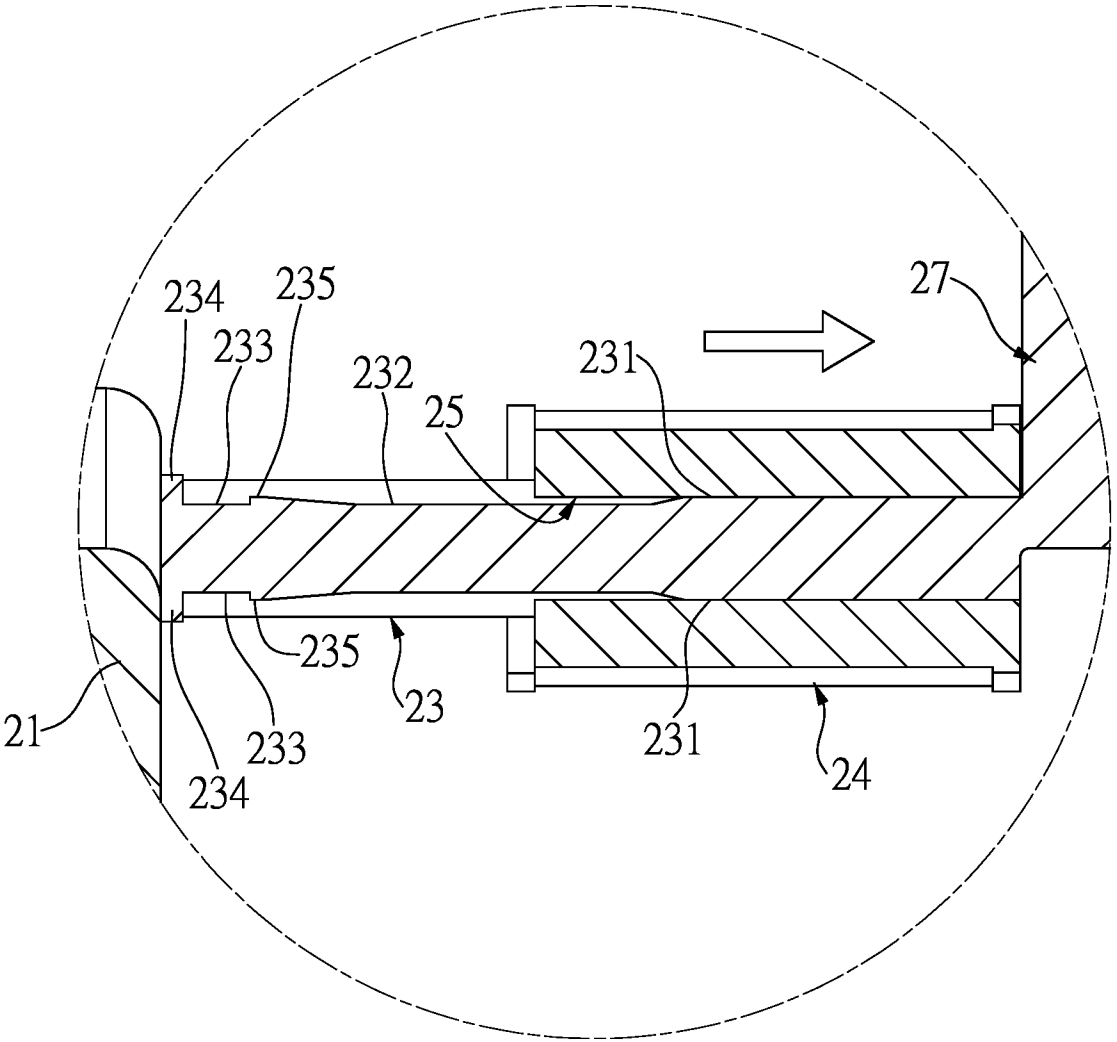
FIG. 8 is a cross sectional view, taken along line VII-VII of FIG. 7.
Figure 9:
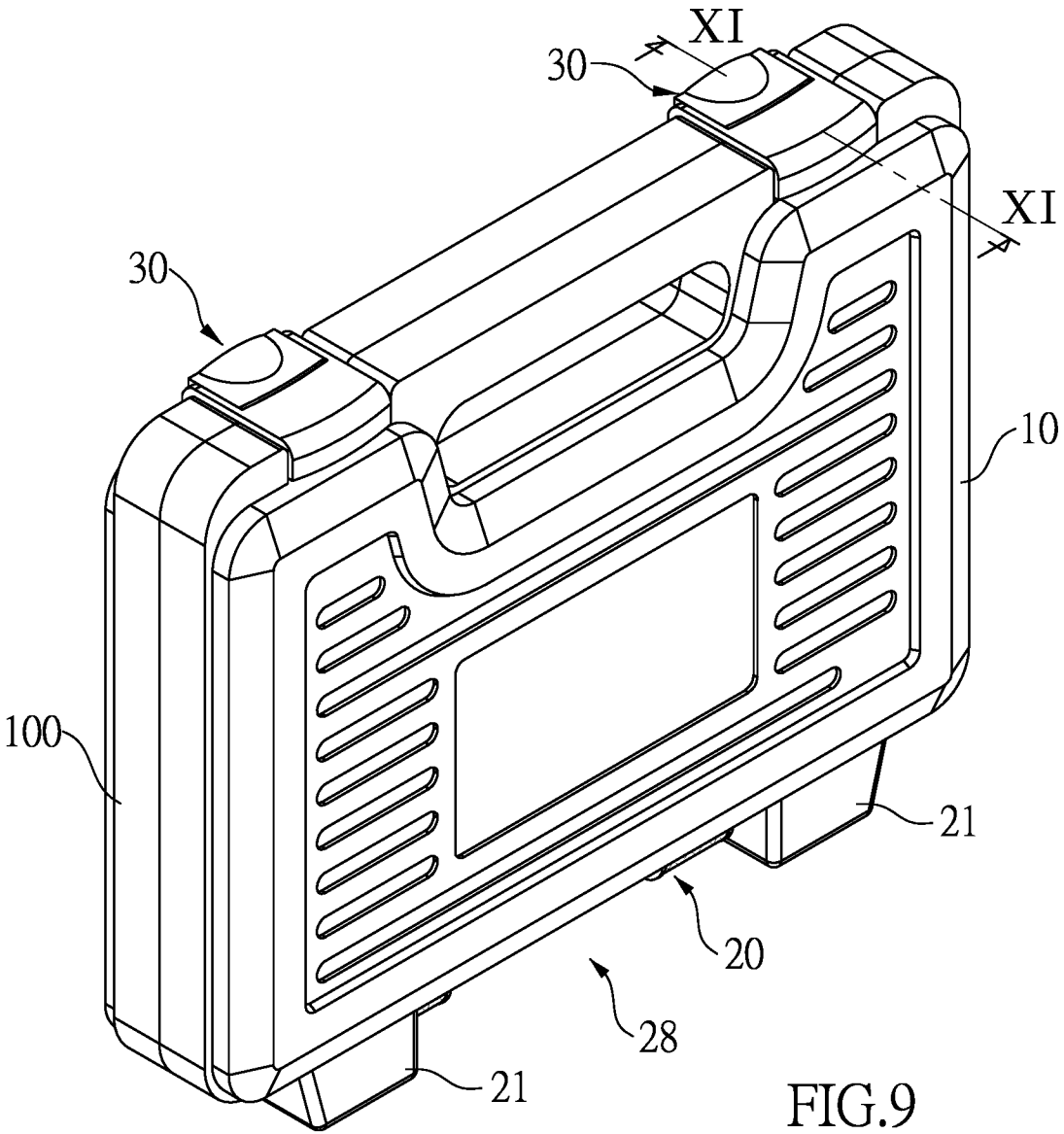
FIG. 9 shows that the first and second parts of the tool box are locked together.
Figure 10:
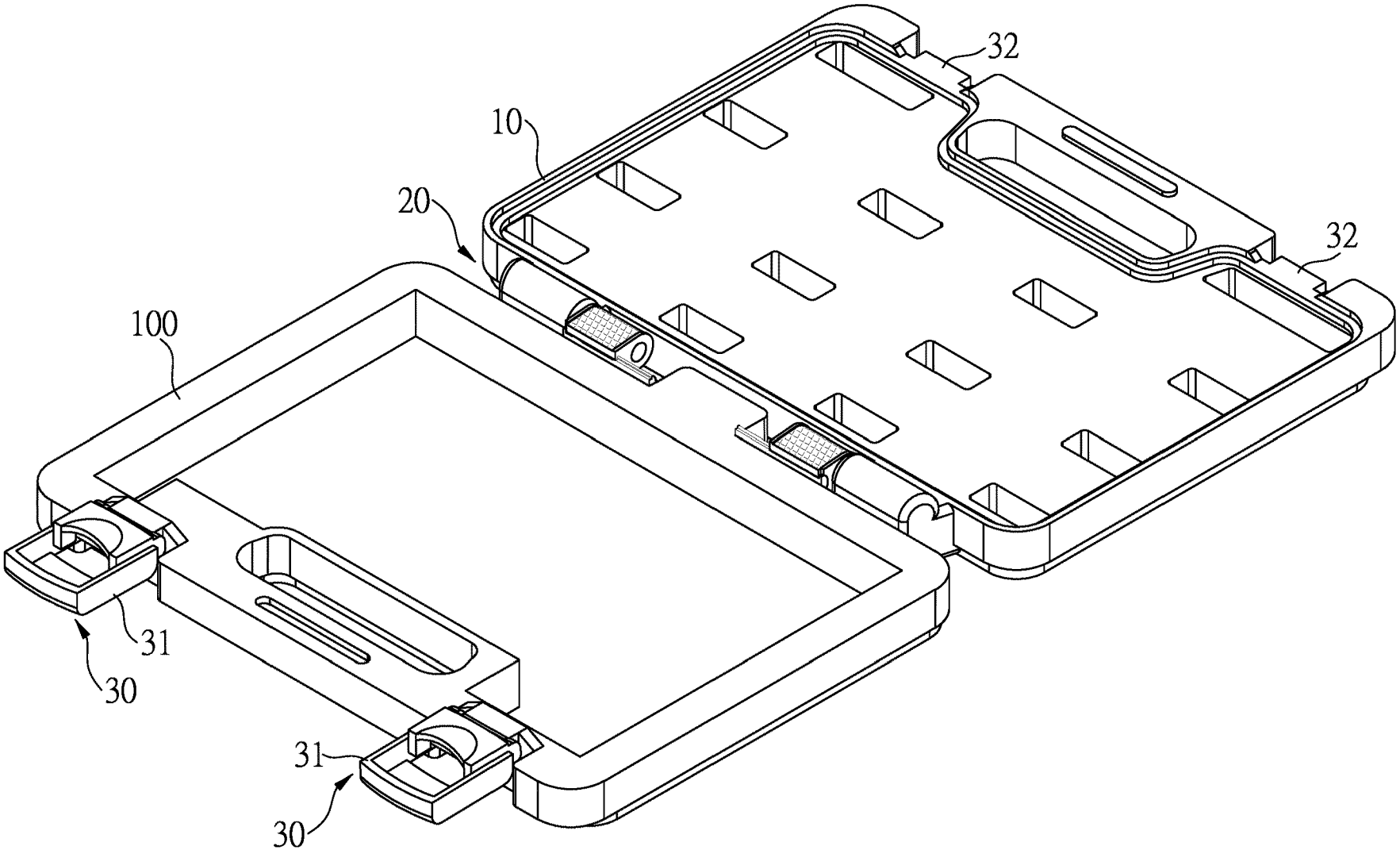
FIG. 10 shows that the first and second parts of the tool box are opened relative to each other.

As shown in FIGS. 2 to 4, the second part 100 has two rails 23 formed on the first side thereof, and two slides 24 are slidably connected the first side of the second part 100. Each slide 24 has a groove 25 in which the rail 23 is slidably received. The two rails 23 and the two slides 24 are located corresponding to the recessed area 28 of the first part 10. Specifically, the second part 100 includes a stop 27 protruding from the first side thereof, and the stop 27 is located within the recessed area 28 of the first part 10. The stop 27 is formed between the two rails 23, two ends of the stop 27 respectively stop the two slides 24. The stop 27 includes a support face 272 which is substantially perpendicular to the two ends of the stop 27. The support face 272 is a flat face, and the two blocks 21 each have a flat face so that the support face 272 and the two flat faces of the two block are put on the desk or ground when the tool box is put upright as shown in FIG. 9. Each slide 24 has a passage 26, and each of the pivots 22 is removably inserted into the passage 26 corresponding thereto. The two passages 26 are parallel to the two grooves 25. Specifically, each rail 23 includes a base portion 231, a first recessed portion 232 and a second recessed portion 233. The first recessed portion 232 is formed between the base portion 231 and the second recessed portion 233. The base portion 231 of each rail 23 extends from the stop 27. Each slide 24 movable along the base portion 231, the first recessed portion 232 and the second recessed portion 233 of the rail 23 corresponding thereto.

As shown in FIGS. 5 to 8, when assembling the first and second parts 10, 100, the two slides 24 are slid along the two rails 23 and toward the blocks 21 to insert the two pivots 22 in the two passages 26. Specifically, each of the grooves 25 moves from the base portion 231 to the first recessed portion 232, and then moves to the second recessed portion 233. When separating the first and second parts 10, 100, the two slides 24 are slid in the reverse direction, and the two pivots 22 are separated from the two passages 26. Specifically, each of the grooves 25 moves from the second recessed portion 233, via the first recessed portion 232 and then moves to the base portion 231. Each rail 23 has an end portion 234 formed on the distal end of the second recessed portion 233 to prevent the rail 23 from separating from the groove 25. The size of the cross section of the base portion 231 is larger than that of the first recessed portion 232, and the cross section of the first recessed portion 232 is larger than that of the second recessed portion 233. Therefore, the resistance between the base portion 231 and the inside of the groove 25 is larger than that between the first recessed portion 232 and the inside of the groove 25. The assemblers is acknowledged the position of the slides 24 relative to the rails 23 by the resistance. As shown in FIG. 4, the cross section of each of the rails 23 is shaped as a mushroom, and includes a head 236 and a shank 237. The shape of each of the grooves 25 is designed to match the shape of the rail 23.

As shown in FIGS. 9 to 13, the locking assembly 30 includes two locking units 31 formed on the second part 100, and two locking seats 32 are formed on the first part 10. The two locking units 31 are engaged with the two locking seats 32 to lock the first and second parts 10, 100 together.

Figure 11:
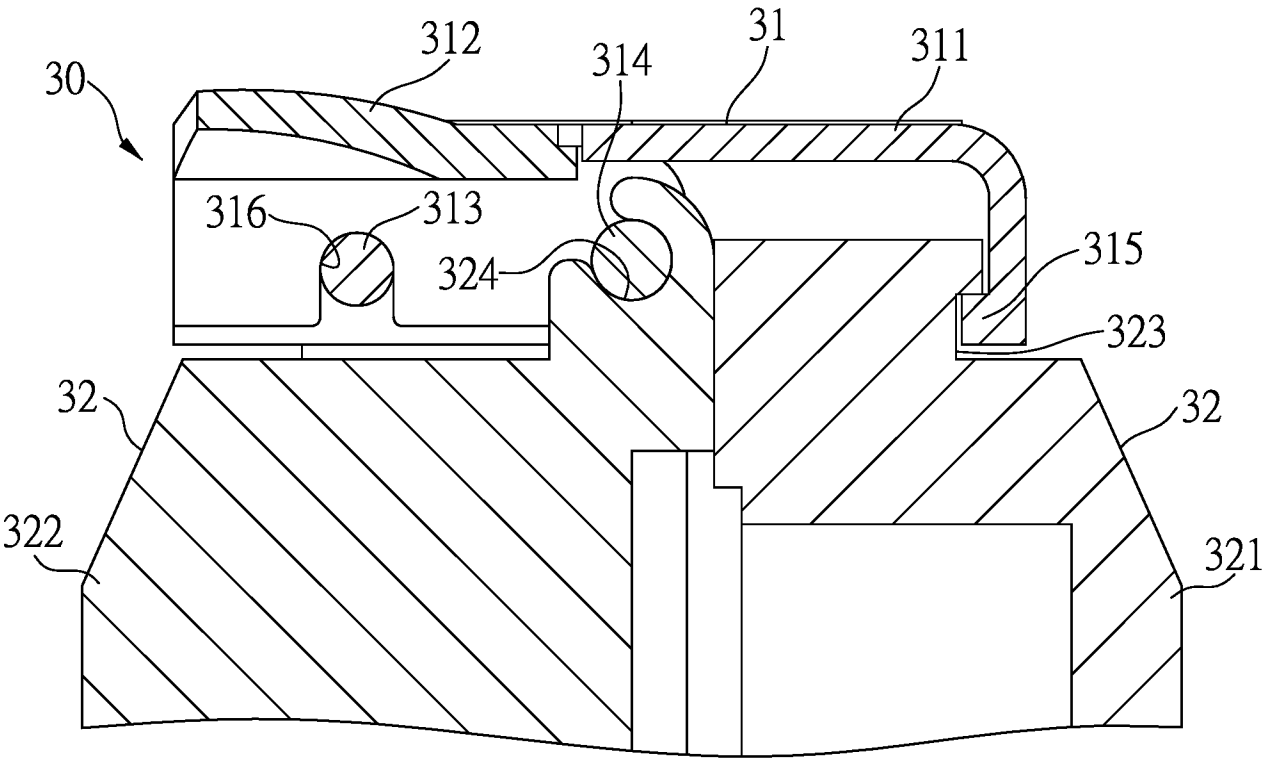
FIG. 11 is a cross sectional view, taken along line XI-XI of FIG. 9.
Figure 12:
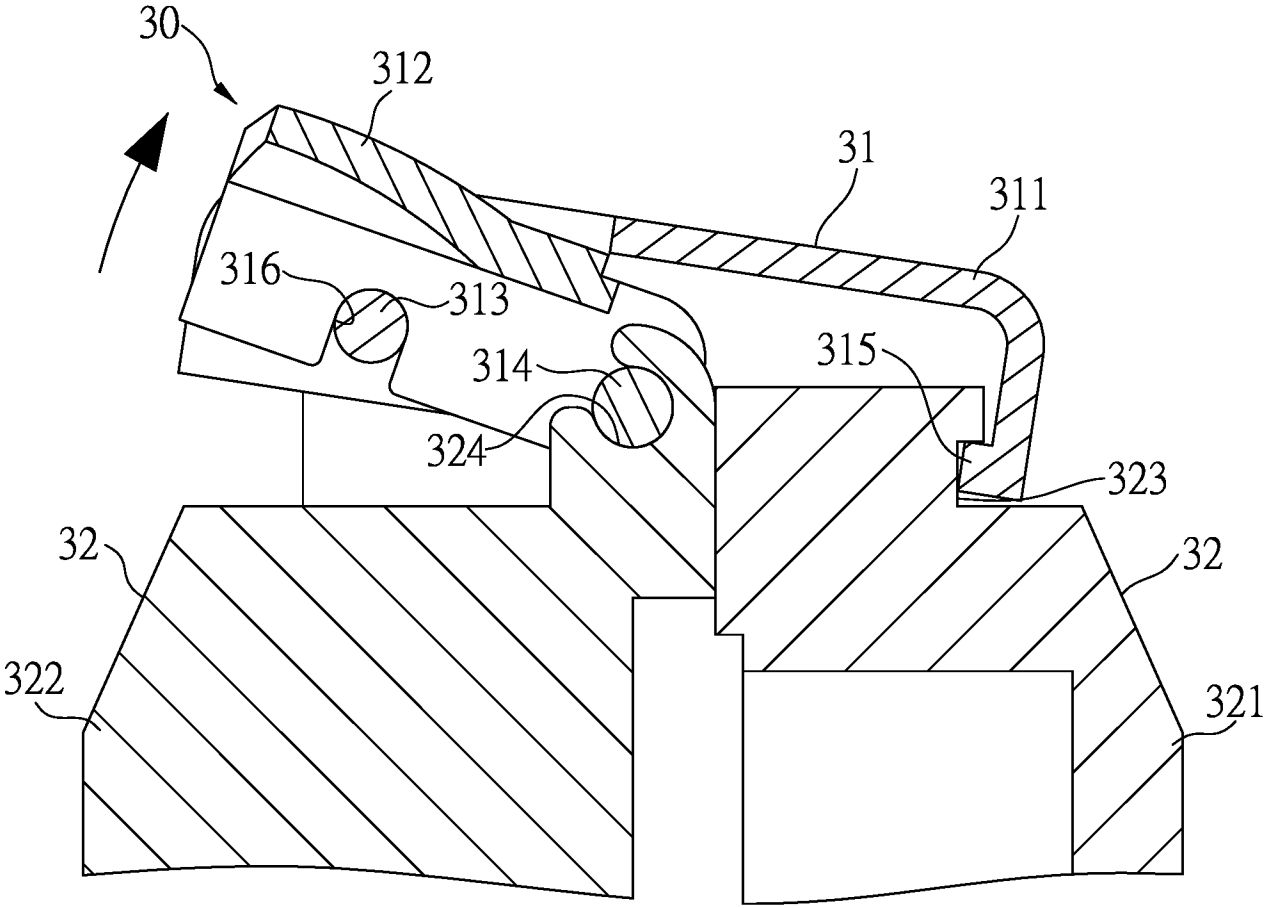
FIG. 12 shows that the locking assembly is to be unlocked.
Figure 13:
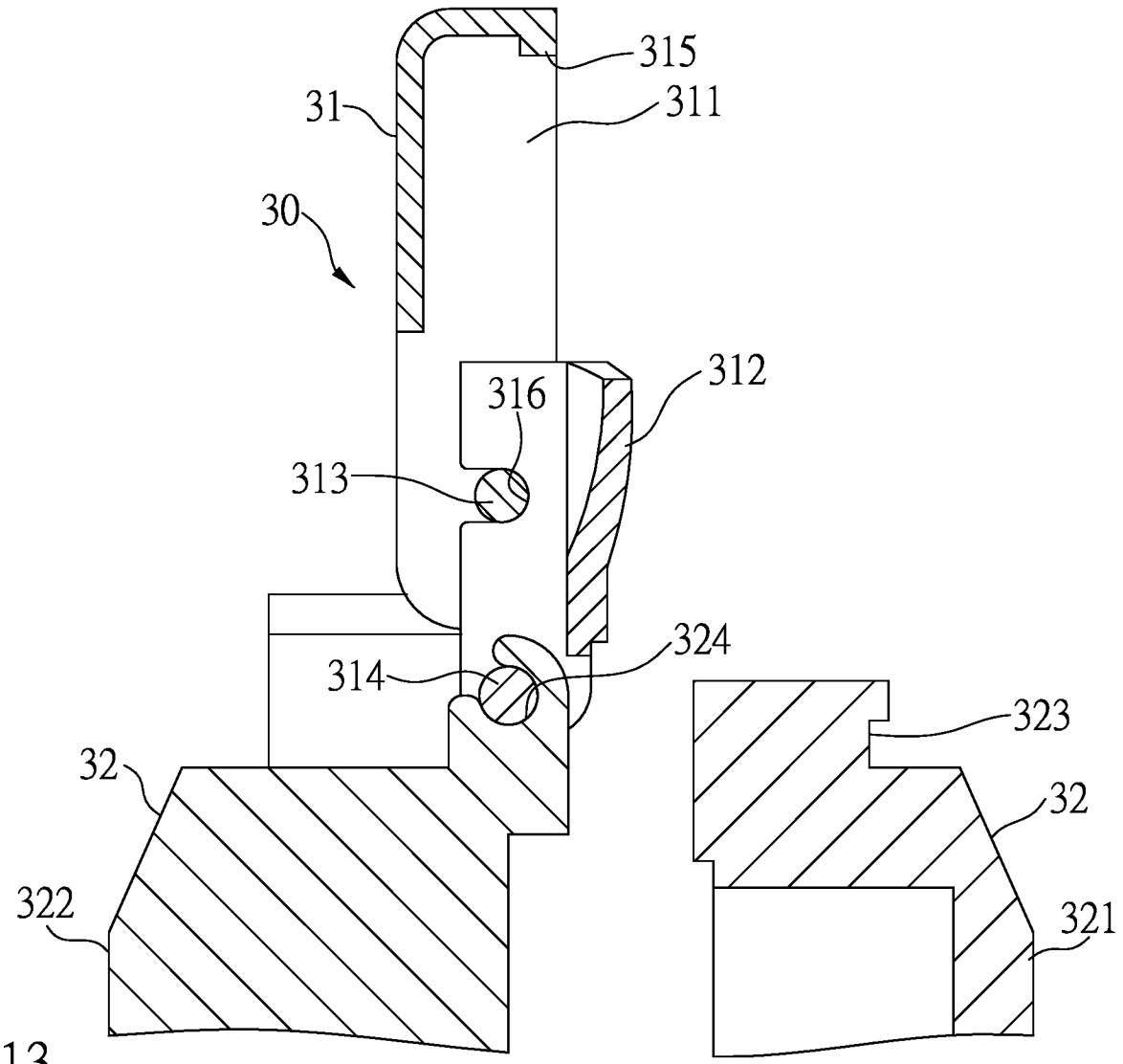
FIG. 13 shows that the locking assembly is unlocked.

As shown in FIGS. 11 to 13, each of the locking units 31 includes a first locking plate 311 and a second locking plate 312. The first locking plate 311 has a first rod 313 to which the second locking plate 312 is connected. The second locking plate 312 has a second rod 314 to which the locking seat 32 is connected. The second locking plate 312 further has an engaging groove 316 with which the first rod 313 is engaged. The first locking plate 311 includes a hook 315 located opposite to the engaging groove 316.

Each locking seat 32 includes a first piece 321 and a second piece 322, wherein the first piece 321 has a first slot 323, and the hook 315 is hooked with the first slot 323 to close the first and second parts 10, 100 to close the tool box. Alternatively, the hook 315 is separated from the first slot 323 to separate the first and second parts 10, 100 open the tool box. Each second piece 322 has a second slot 324 with which the second rod 314 is engaged. The second locking plate 312 is pivoted forward or backward about the second rod 314.

While we have shown and described the embodiment in accordance with the present invention, it should be clear to those skilled in the art that further embodiments may be made without departing from the scope of the present invention.

What is claimed is:

1. A tool box comprising:

a first part and a second part, the first and second parts pivotably connected to each other by a pivotal portion located at a first side of each of the first and second parts, the first part having two blocks formed on the first side thereof, a recessed area formed between the two blocks, each block having a pivot extending from one end thereof, the two pivots extending in the recessed area;

the second part having two rails formed on the first side thereof, two slides slidably connected the first side of the second part, each slide having a groove in which the rail is slidably received, the two rails and the two slides located within the recessed area of the first part, each slide having a passage, each of the pivots removably inserted into the passage corresponding thereto, each rail including a base portion, a first recessed portion and a second recessed portion, the first recessed portion formed between the base portion and the second recessed portion, each slide movable along the base portion, the first recessed portion and the second recessed portion of the rail, each rail having an end portion formed on a distal end of the second recessed portion to prevent the rail from separating from the groove, a resistance between the base portion and an inside of the groove being larger than a resistance between the first recessed portion and the inside of the groove, and a locking assembly connected to a second side of each of the first and second parts.

2. The tool box as claimed in claim 1, wherein the second part includes a stop formed thereto which is located within the recessed area of the first part, the stop is formed between the two rails, two ends of the stop respectively stop the two slides.

3. The tool box as claimed in claim 1, wherein the two passages are parallel to the two grooves.

4. The tool box as claimed in claim 1, wherein the two pivots share a common axis.

5. The tool box as claimed in claim 2, wherein the base portion of each rail extends from the stop.

6. The tool box as claimed in claim 5, wherein the stop includes a support face which is substantially perpendicular to the two ends of the stop.

7. The tool box as claimed in claim 6, wherein the locking assembly includes two locking units formed on the second part, and two locking seats formed on the first part, the two locking units are engaged with the two locking seats to lock the first and second parts together.

* * * * *